United States Patent [19]

Blanchard

[11] 4,275,517

[45] Jun. 30, 1981

[54] PHOTOGRAPH MOUNT

[75] Inventor: Roland H. Blanchard, New Bedford, Mass.

[73] Assignee: Winthrop-Atkins Co., Inc., Middleboro, Mass.

[21] Appl. No.: 8,389

[22] Filed: Feb. 1, 1979

Related U.S. Application Data

[63] Continuation of Ser. No. 779,198, May 23, 1977, abandoned.

[51] Int. Cl.[3] ..... A47G 1/06; G09F 1/10

[52] U.S. Cl. ..... 40/158 R; 40/124.1; 40/152.1; 40/159

[58] Field of Search ..... 40/158 R, 158 B, 158 A, 40/159, 156, 152, 152.1, 124.1, 594; 229/40; 206/450, 472, 475; 156/227; 428/14

[56] References Cited

U.S. PATENT DOCUMENTS

| | | | |
|---|---|---|---|
| 1,249,328 | 12/1917 | Childs | 40/158 R |
| 2,453,902 | 11/1948 | Graham | 40/124.1 X |
| 2,889,646 | 6/1959 | Matthias et al. | 40/159 |
| 3,174,244 | 3/1965 | Walton | 40/158 R |
| 3,357,671 | 12/1967 | Ketterer | 40/124.1 X |
| 3,545,115 | 12/1970 | Nichols | 40/152.1 |
| 3,869,820 | 3/1975 | Holson | 40/159 |

*Primary Examiner*—John F. Pitrelli
*Assistant Examiner*—G. Lee Skillington
*Attorney, Agent, or Firm*—Robert T. Gammons

[57] ABSTRACT

A photograph mount comprising a frame and cover hinged thereto along one edge so that by disposing the cover at an angle to the frame, the structure may set upright on the lower edges of the frame and cover and wherein the frame comprises a back board, an intermediate board coextensive therewith and a face board containing a photograph opening; and a blank for making a photograph mount such as described.

1 Claim, 8 Drawing Figures

PHOTOGRAPH MOUNT

This is a continuation of application Ser. No. 779,198 filed May 23, 1977, now abandoned.

BACKGROUND OF INVENTION

Photograph mounts comprised of a plurality of hinged panels are well-known in the art as shown, for example, in U.S. Pat. Nos. 3,545,115; 3,174,244; 3,341,961; 2,782,542; 2,538,894; 1,539,615 and 1,249,328. The photograph mount of this invention differs from any of the aforesaid patented structures in its simplicity of construction which makes it especially adapted for manufacture with conventional die cutting and gluing machinery without special techniques, its sturdy construction and its attractiveness.

SUMMARY OF INVENTION

As herein illustrated, the photograph mount comprises a frame and cover hinged thereto along one edge such that, when disposed at an angle thereto, the structure will stand upright on the lower edges of the frame and cover, said frame comprising a back board, an intermediate board coextensive therewith and a face board containing a photograph opening, hinge means connecting the intermediate board along one edge to the backboard and along the other edge to the face board and adhesive means connecting the opposite edges of the intermediate board to the back board and the other edge of the face board to the intermediate board. A part hinged alone one edge to an edge of the face board and folded behind the face board into engagement with the front face of the intermediate board is secured to the latter by means of adhesive and a part hinged to the lower edge of the face board and folded behind the intermediate board into engagement with the back board is secured to the back face of the intermediate board by means of adhesive.

The blank from which the aforesaid photograph mount is made comprises four rectangular panel boards hingedly connected, two of said panels being of the same width and height and the other two of the same width, but of lesser height, such that the two panels of lesser height can be folded into engagement with each other and, by folding, interposed between the two panels of greater height. One of the panels of lesser height (the end one) contains a window opening for a photograph and along one of its edges a part hinged thereto for folding behind it and along the other of its edges a part hinged thereto for folding behind the other panel of lesser height. The other of the panels of lesser height has along its opposite edges a narrow band of adhesive and the parts hinged to the panel of lesser height at the end have, respectively, a narrow band of adhesive on the outer side of the part hinged to the side edge and a narrow band of adhesive at the inner side of the part hinged to the bottom.

The invention will now be described in greater detail withreference to the accompanying drawings, wherein.

Figure 1:
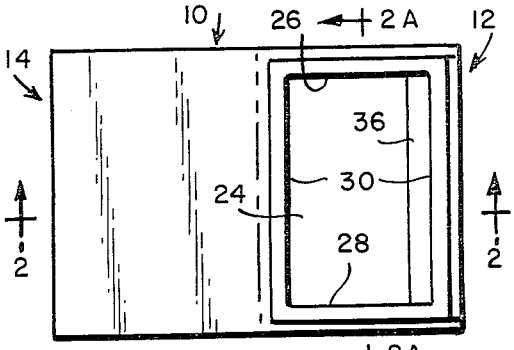
FIG. 1 is a plan view of the photograph mount with the cover folded back from the frame into a common plane therewith.
Figure 3:
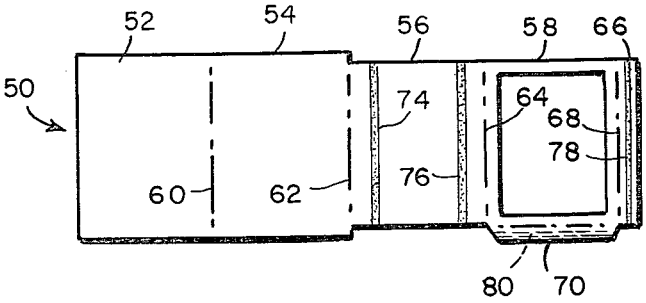
FIG. 3 shows the blank from which the mount is made prior to folding.
Figure 2A:
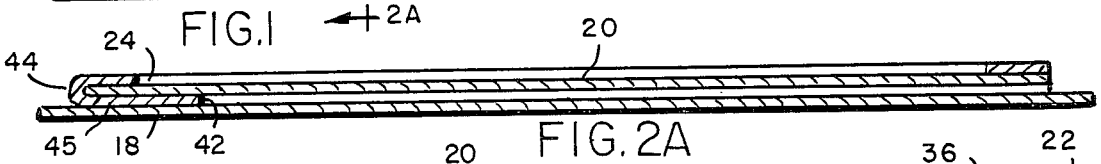
FIG. 2A is an enlarged section taken on the line 2A—2A of FIG. 1.
Figure 2:
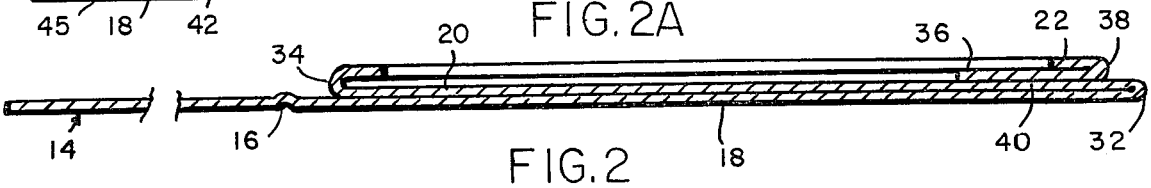
FIG. 2 is an enlarged section taken on the line 2—2 of FIG. 1 with the cover broken away in part.

Referring to the drawings, FIG. 1 shows a mount 10 comprising a frame 12 and a cover 14 hingedly connected along one edge by hinge means 16 to one edge of the frame. By disposing the cover 14 at an angle to the frame 12, the structure may be set upright on the lower edges of the frame and cover in a position of stable equilibrium.

The frame 12 comprises a back board 18, an intermediate board 20 which is coextensive therewith and a face board 22, said parts 18, 20 and 22 lying in parallel relation and said face board 22 containing a photograph opening 24 of rectangular configuration having spaced parallel top and bottom edges 26 and 28 parallel to the top and bottom edges of the face board and spaced parallel side edges 30—33 parallel to the side edges of the face board. The right hand edge of the intermediate board 20 is connected by a hinge 32 to the right-hand edge of the back board 18 and the left-hand edge of the intermediate board is connected by a hinge 34 to the left-hand edge of the face board 22. At the right-hand edge of the face board, there is a part 36 coextensive with that edge and connected thereto by a hinge 38 which is folded behind the face board into engagement with the forward face of the intermediate board and secured thereto by means of adhesive 40. At the lower edge of the face board, there is a part 42 coextensive with the lower edge of the face board connected thereto by a hinge 44 which is folded behind the intermediate board between it and the back board and adhesively secured to the rear side of the intermediate board by means of adhesive 45.

The structure thus described is made of a single blank 50 of sheet material of the appropriate kind and color, preferably a good grade of paper board, by cutting from sheet material on a conventional die-cutting and gluing machine which simultaneously cuts, scores and applies adhesive to the desired areas. The blank comprises four substantially rectangular panels, a first panel 54, a second panel 56, a third panel 58 and a fourth panel 52 connected by score lines 60, 62 and 64 whichprovide hinges upon which the panels may be folded relative to each other. The first panel 54 is the back board, the second panel 56 is the intermediate board, the third panel 58 is the face board and the fourth panel 52 is the cover board. Two of the panels 52 and 54 are of the same width and length and the other two 56 and 58 of the same width but narrower length. Panel 58 at the end has along one edge a part 66 which is connected to that edge by a score line 68 which forms a hinge and along the bottom edge a part 70 which is connected to that edge by a score line 72 which forms a hinge. Simultaneously with the die-cutting and scoring, there are applied to the front surface of the panel 56 near its opposite edges bands of adhesive 74–76 and to the parts 66 and 70 a band of adhesive 78 on the front side of the part 66 and a band of adhesive 80 on the back side of the part 70. The picture opening is formed in the panel 58 simultaneously with the die-cutting, scoring and adhesive-applying operation.

The blank as thus constructed is folded successively to produce the mount as shown in FIGS. 4, 5, 6 and 7.

Figure 4:
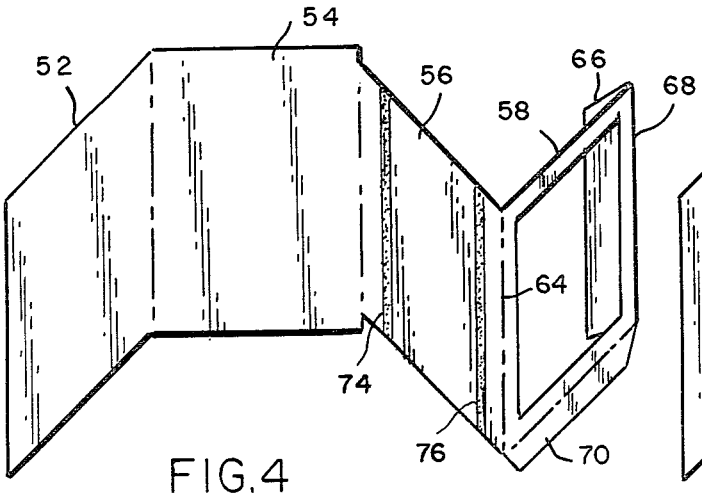
FIG. 4 shows the first step for folding the blank.
Figure 5:
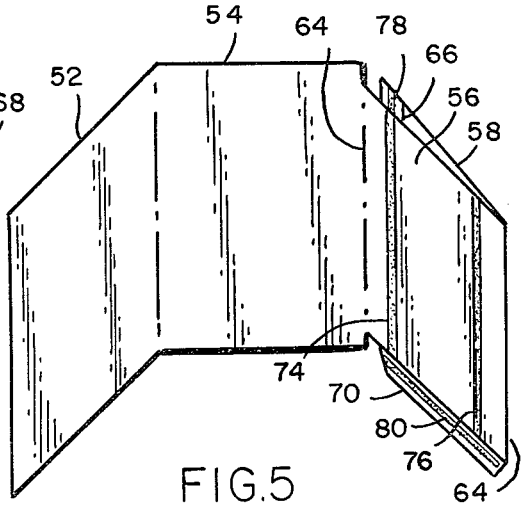
FIG. 5 shows the second step in folding the blank.
Figure 6:
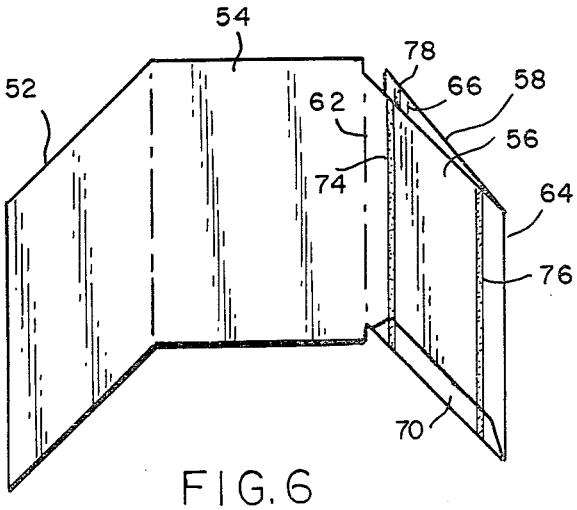
FIG. 6 shows the third step in folding the blank.
Figure 7:
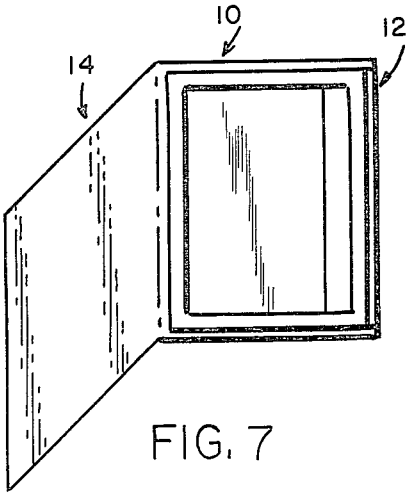
FIG. 7 shows the fourth and final step in folding the blank.

As a first step, the part 66 is folded on the hinge line 68 behind the panel 58 as shown in FIG. 4 whereupon the panel 58 is folded on the hinge 64 behind the panel 56 and adhered thereto by means of the adhesive strip 78 which is on the front side of the part 66 as shown in FIG. 5. Now the part 70 is folded onto the rear side of the panel 56 and secured thereto by means of the adhesive 80. Following this, the two panels 56 and 58 are folded on the hinge line 62 into engagement with the front face of the panel 54 and secured thereto by means of the bands of adhesive 74 and 76, thus completing the mount as shown in FIG. 7. As thus folded, the panels 56 and 58 are contained within the upper and lower edges and the side edges of the back panel 54 and when the cover is folded over the face of the frame, since it is coextensive in area with the back panel, it covers the entire face of the frame.

The structure as thus made up is especially suited for economical manufacture with the least waste of material on conventional die-cutting, scoring and gluing machinery, is of sturdy construction, requires the minimum amount of assembly work and is attractive.

It should be understood that the present disclosure is for the purpose of illustration only and includes all modifications or improvements which fall within the scope of the appended claims.

I claim:

1. A photograph mount comprised of four rectangular panels of relatively stiff cardboard, a first panel comprising an imperforate back board, a second panel comprising an imperforate intermediate board, said intermediate board being positioned with its front side in contact with the front side of the back board, hinge means connecting one edge of the intermediate board to one edge of the back board, adhesive affixing the intermediate board in contact with the back board, a third panel comprising a face board, said face board being positioned with its back side in contact with the back side of the intermediate board, hinge means connecting an edge of the face board to the distal edge of the intermediate board, adhesive affixing the back side of the face board in contact with the back side of the intermediate board, said face board containing a window opening, said face board having along its distal edge and along its lower edge hinged flaps disposed, respectively, between the face board and the intermediate board and against the front side of the intermediate board between it and the back board, adhesive affixing the flaps, respectively, to the opposite sides of the intermediate board and to the back board, said intermediate board constituting the back of a pocket comprised of the intermediate board, face board and flaps secured to the front side of the back board, said pocket being closed at the bottom along the opposite sides and open at the top, said pocket being of a front to back depth perpendicular to the face board substantially equal to the thickness of the material of which the structure is comprised for slidingly receiving a photograph for display through the window opening, a fourth panel comprising a cover board and hinge means connecting an edge of the cover board to the opposite edge of the back board so that it can be folded over the intermediate board and face board to cover the same, said pocket defined by the intermediate and face boards being narrower in width and shorter in length than the back board and cover board so as to be completely concealed by folding of the cover board over the back board.

* * * * *